US006163113A

United States Patent [19]

Fu

[11] Patent Number: 6,163,113

[45] Date of Patent: Dec. 19, 2000

[54] PROTECTING DEVICE FOR A STRING OF SERIES CONNECTED LAMPS

[76] Inventor: Fang-Cheng Fu, 1F, No. 15, Lane 183, Kung-Yuan Rd., Hsinchu City, Taiwan

[21] Appl. No.: 09/374,799

[22] Filed: Aug. 16, 1999

[51] Int. Cl.[7] ..... H05B 37/03

[52] U.S. Cl. ..... 315/185 S; 315/59; 315/185 R; 315/210

[58] Field of Search ..... 315/185 S, 185 R, 315/225, 58, 59, 60, 210

[56] References Cited

U.S. PATENT DOCUMENTS

| | | | |
|---|---|---|---|
| 3,968,398 | 7/1976 | Lehmann et al. | 315/185 S |
| 4,223,248 | 9/1980 | Tong | 315/185 S |
| 4,227,228 | 10/1980 | Cheng | 315/185 S |
| 4,425,605 | 1/1984 | Cheng | 315/185 S |

*Primary Examiner*—David Vu
*Assistant Examiner*—Wilson Lee
*Attorney, Agent, or Firm*—Ostrolenk, Faber, Gerb & Soffen, LLP

[57] ABSTRACT

A non-light emitting protecting device is adapted to be used with a string of lamp sockets that connect electrically a plurality of lamps in series. The protecting device includes a shell, and a conductor circuit encapsulated by the shell. The shell has a size and shape corresponding to the lamps so as to be adapted to be mounted in any one of the lamp sockets. The conductor circuit has two terminals, and a rated circuit connected between the terminals. Each of the terminals has a free end that extends outwardly of the shell and that is adapted to be connected in series with the lamps when the shell is mounted in one of the lamp sockets. The rated circuit is capable of breaking electrical connection between the terminals when current flowing therethrough exceeds a predetermined rated current.

6 Claims, 2 Drawing Sheets

PROTECTING DEVICE FOR A STRING OF SERIES CONNECTED LAMPS

BACKGROUND OF THE INVENTION

1. Field of the Invention

The invention relates to protecting device for an electrical circuit, more particularly to a non-light emitting protecting device for a string of series connected lamps.

2. Description of the Related Art

At present, a connecting device, such as an aluminum oxide wire, is connected in parallel to filaments of a string of series connected lamps for providing a conducting path when the filament of any one of the lamps breaks down. When some of the lamps in the lamp string break down, the load voltage of the other lamps, the current flowing therethrough, and the operating temperature will increase, thereby damaging more lamps and resulting in the risk of short circuiting. Also, a lot of time is needed to replace the damaged lamps.

SUMMARY OF THE INVENTION

Therefore, the object of the present invention is to provide a non-light emitting protecting device for a string of lamp sockets which can control efficiently and safety operating current.

According to the present invention, a non-light emitting protecting device is adapted to be used with a string of lamp sockets that connect electrically a plurality of lamps in series. The protecting device includes a shell, and a conductor circuit encapsulated by the shell. The shell has a size and shape corresponding to the lamps so as to be adapted to be mounted in any one of the lamp sockets. The conductor circuit has two terminals, and a rated circuit connected between the terminals. Each of the terminals has a free end that extends outwardly of the shell and that is adapted to be connected in series with the lamps when the shell is mounted in one of the lamp sockets. The rated circuit is capable of breaking electrical connection between the terminals when current flowing therethrough exceeds a predetermined rate current.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
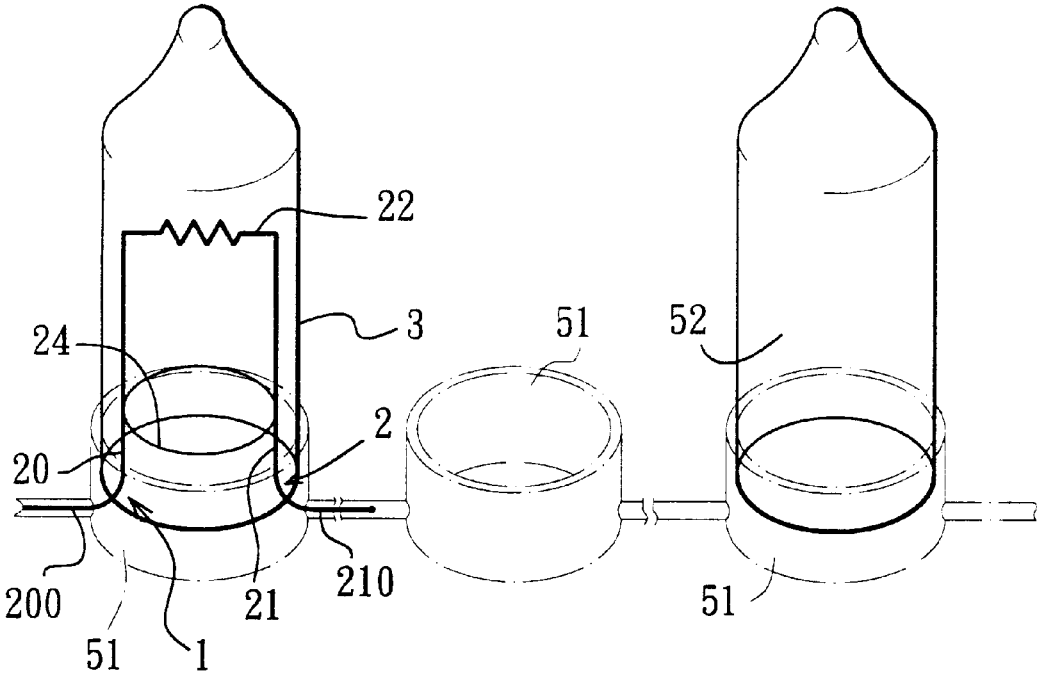
FIG. 1 is a perspective schematic view of the preferred embodiment of a non-light emitting protecting device according to the present invention.

Referring to FIG. 1, according to the preferred embodiment of the present invention, a non-light emitting protecting device 1 is adapted to be used with a string of lamp sockets 51 that connect electrically a plurality of lamps 52 in series. The protecting device 1 includes a shell 3 and a conductor circuit 2.

The shell 3 has a size and shape corresponding to the lamps 52 so as to adapted to be mounted in any one of the lamp sockets 51.

The conductor circuit 2, which is encapsulated by the shell 3, has two parallel terminals 20, 21 made of metal, a glass bead 24,and a rated circuit 22 connected between the terminals 20, 21. Each of the terminals 20, 21 has a free end 200, 210 that extends outwardly of the shell 2 and that is adapted to be connected in series with the lamps 52 when the shell 3 is mounted in one of the lamp sockets 51. The glass bead 24 is disposed inside the shell 3 between the terminals 20, 21 to maintain an appropriate distance between the terminals. The rated circuit 22 is made of a highly resistive material, such as tungsten or carbon, and is capable of breaking electrical connection between the terminals 21, 22 when current flowing therethrough exceeds a predetermined rated current.

Figure 2:
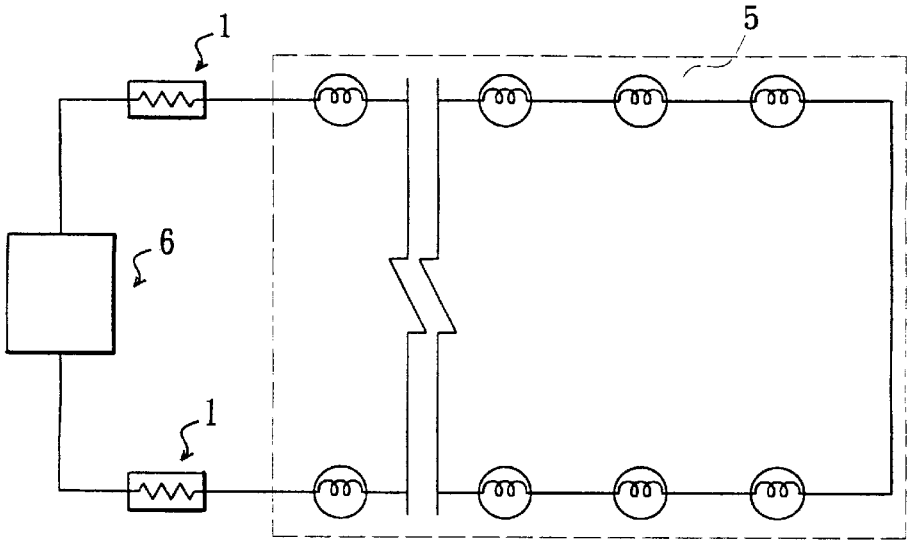
FIG. 2 is a schematic diagram showing the preferred embodiment when used with a string of series connected lamps.
Figure 3:
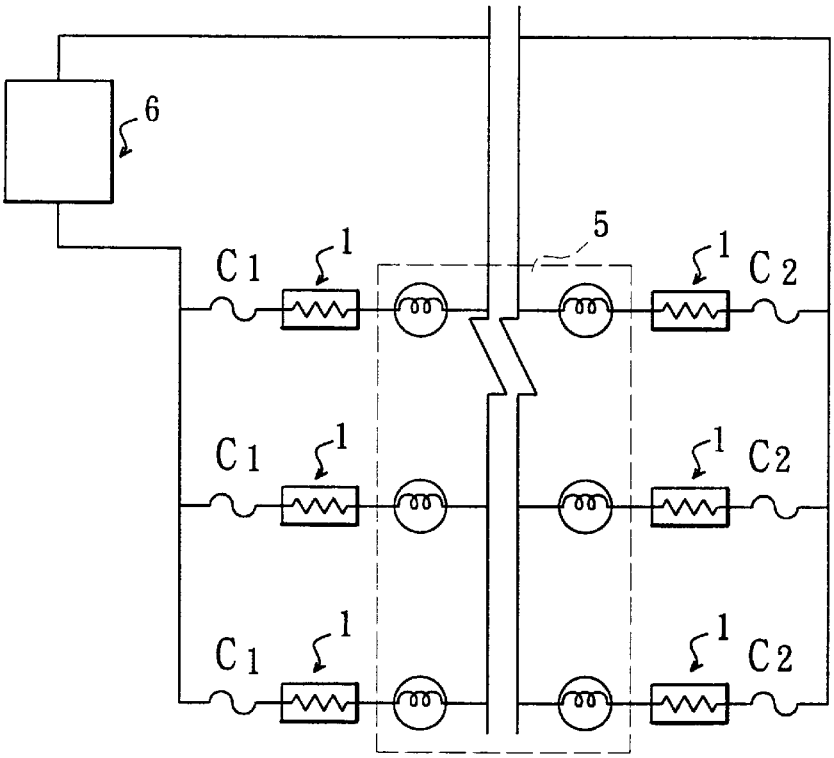
FIG. 3 is a schematic diagram showing the preferred embodiment when used with parallel strings of series connected lamps.

As shown in FIG. 2, a lamp-string circuit includes a power source 6, two protecting devices 1 connected to the power source 6, and a string 5 of lamps. The string 5 has two ends connected respectively to the power source 6 via the protecting devices 1. As shown in FIG. 3, a lamp-string circuit consists of the power source 6, and a plurality of strings of lamps connected to the power source 6 in parallel. Each of the strings has two fuses $C_1$, $C_2$ connected respectively in series to two ends thereof. When there are damaged lamps in the lamp-string circuits, there will be a rise in operating temperature and in current flowing therethrough. The protecting device 1 can be used to replace the damage lamps. Thus, when the current exceeds the predetermined rated current of the rated circuits 2, the rated circuits 2 break open to protect the lamps. In general, since the rated current of the protecting device 1 is smaller than that of the lamp, the protecting device 1 will pull down the total current consumption of the lamp-string circuit. If the rated circuit 2 is rated at 2.5V/0.17A, and the lamp is rated at 2.5V/0.2A, the total current consumption can be as low as 0.19A, which is lower than the rated current of the lamp so as to extend the service life of the lamp and limit the occurrence of large current flows in the lamp-string circuit.

For example, in FIG. 2, the string 5 can have fifty lamp sockets with forty-eight lamps having a 2.5V/0.2A specification and two protecting devices 1 disposed at two ends of the string 5 instead of the lamps. The specification of the rated circuit 2 is 2.5V/0.17A. Under the condition that the power source 6 is 120V, when 40%~50% of the lamps in the string 5 are damaged, the load voltage of the string 5 increases 4~5V, and the current flowing through the lamp string 5 can reach 0.238~0.275A. When the protecting devices 1 are not in use. However, because the protecting devices 1 break open at currents greater 0.17A, adequate protection is thus provided to the lamps when the protecting devices 1 of this invention are in use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A non-light emitting protecting device adapted to be used with a string of lamp sockets that connect electrically a plurality of lamps in series, said protecting device comprising:

a shell having a size and shape corresponding to the lamps so as to be maintable in any one of the lamp sockets; and a conductor circuit encapsulated by said shell, said conductor circuit having two terminals, and a non-incandescent rated circuit connected between said terminals, each of said terminals having a free end that extends outwardly of said shell and that is adapted to be connected in series with the lamps when said shell is mounted in one of the lamp sockets, said rated circuit being capable of breaking electrical connection between said terminals when current flowing therethrough exceeds a predetermined rated current.

2. The protecting device as claimed in claim 1, wherein said terminals are made of metal.

3. The protecting device as claimed in claim 1, wherein said rated circuit is made of a highly resistive material.

4. The protecting device as claimed in claim 1, wherein said rated circuit is made of tungsten.

5. The protecting device as claimed in claim 1, wherein said rated circuit is made of carbon.

6. The protecting device as claimed in claim 1, further comprising a glass bead disposed inside said shell between said terminals to maintain an appropriate distance between said terminals.

* * * * *